US011389368B2

(12) United States Patent
Sgambelluri et al.

(10) Patent No.: US 11,389,368 B2
(45) Date of Patent: Jul. 19, 2022

(54) AMBLYOPIA TREATMENT SYSTEM

(71) Applicant: Pacific Vision Foundation, San Francisco, CA (US)

(72) Inventors: Michael Sgambelluri, Kitchener (CA); Jared Adams, Walnut Creek, CA (US)

(73) Assignee: Pacific Vision Foundation, San Francisco, CA (US)

( * ) Notice: Subject to any disclaimer, the term of this patent is extended or adjusted under 35 U.S.C. 154(b) by 55 days.

(21) Appl. No.: 15/935,337

(22) Filed: Mar. 26, 2018

(65) Prior Publication Data

US 2019/0290528 A1 Sep. 26, 2019

(51) Int. Cl.
*A61H 5/00* (2006.01)

(52) U.S. Cl.
CPC ..... *A61H 5/00* (2013.01); *A61H 2201/5015* (2013.01)

(58) Field of Classification Search
CPC ..... A61H 5/00
USPC ..... 351/200–201, 246
See application file for complete search history.

(56) References Cited

U.S. PATENT DOCUMENTS 4,582,401 A * 4/1986 Grindle ..... G02C 7/16 351/158
2001/0050754 A1* 12/2001 Hay ..... G02C 7/101 351/213
2003/0214630 A1* 11/2003 Winterbotham ..... A61H 5/00 351/203
2004/0156554 A1* 8/2004 McIntyre ..... G06T 5/00 382/254
2011/0309236 A1* 12/2011 Tian ..... H01L 27/14603 250/208.1
2015/0265146 A1* 9/2015 Bloom ..... A61B 3/085 351/202
2016/0128893 A1* 5/2016 Ooi ..... A61B 3/08 351/201
2016/0270656 A1* 9/2016 Samec ..... A61B 3/024
2017/0065598 A1* 3/2017 Bear ..... A61K 31/4168

* cited by examiner

*Primary Examiner* — James R Greece
(74) *Attorney, Agent, or Firm* — Schott, P.C.

(57) ABSTRACT

A method for treating amblyopia in a patient includes: providing a virtual reality headset having a display that provides a first display to a left eye and a second display to the right eye; and manipulating one of the first display or the second display such that the manipulation encourages a patent's amblyopic eye to perform more work than the non-amblyopic eye.

10 Claims, 6 Drawing Sheets

AMBLYOPIA TREATMENT SYSTEM

BACKGROUND

Amblyopia, sometimes called "lazy eye" is a common vision problem that occurs when vision in one or both eyes does not develop properly during childhood. The conditions that cause amblyopia may include strabismus, in which the eyes are crossed inward (esotropia) or turned outward (exotropia) and anisometropia, in which there is a major difference in refractive error between the two eyes from nearsightedness, farsightedness, or astigmatism. Less common causes of amblyopia include ptosis (drooping) of one eyelid, disease of the cornea (preventing light from entering the eye), congenital cataract, and injury to the eye of a young child.

For people with amblyopia, the brain favors one eye over the other and the other eye is ignored. It is not adequately stimulated and the visual brain cells do not mature normally. Amblyopia is the most common cause of monocular blindness, partial or complete blindness in one eye and it affects 2 to 3% of children in the US.

Treatment may involve surgical correction of the eye muscle imbalance. In the case of severe refractive error, it should be corrected by glasses, contact lenses or, if appropriate, laser surgery. Wearing an eye patch over the stronger eye is a traditional treatment for amblyopia. Another option is atropine eye drops to blur the vision temporarily in the stronger eye.

Adults with amblyopia respond more slowly (if at all) to some treatments and thus, doctors often look to early diagnosis and treatment for best results. One challenge, however, is that children may not be fully diligent in adherence to treatment (pulling off eye patches, removing lenses, resisting drops). This invention seeks to overcome some of the current amblyopia treatment challenges.

SUMMARY OF THE EMBODIMENTS

A method for treating amblyopia in a patient includes: providing a virtual reality headset having a display that provides a first display to a left eye and a second display to the right eye; and manipulating one of the first display or the second display such that the manipulation encourages a patent's amblyopic eye to perform more work than the non-amblyopic eye.

DETAILED DESCRIPTION OF THE EMBODIMENTS

Hardware Introduction

Figure 1A:
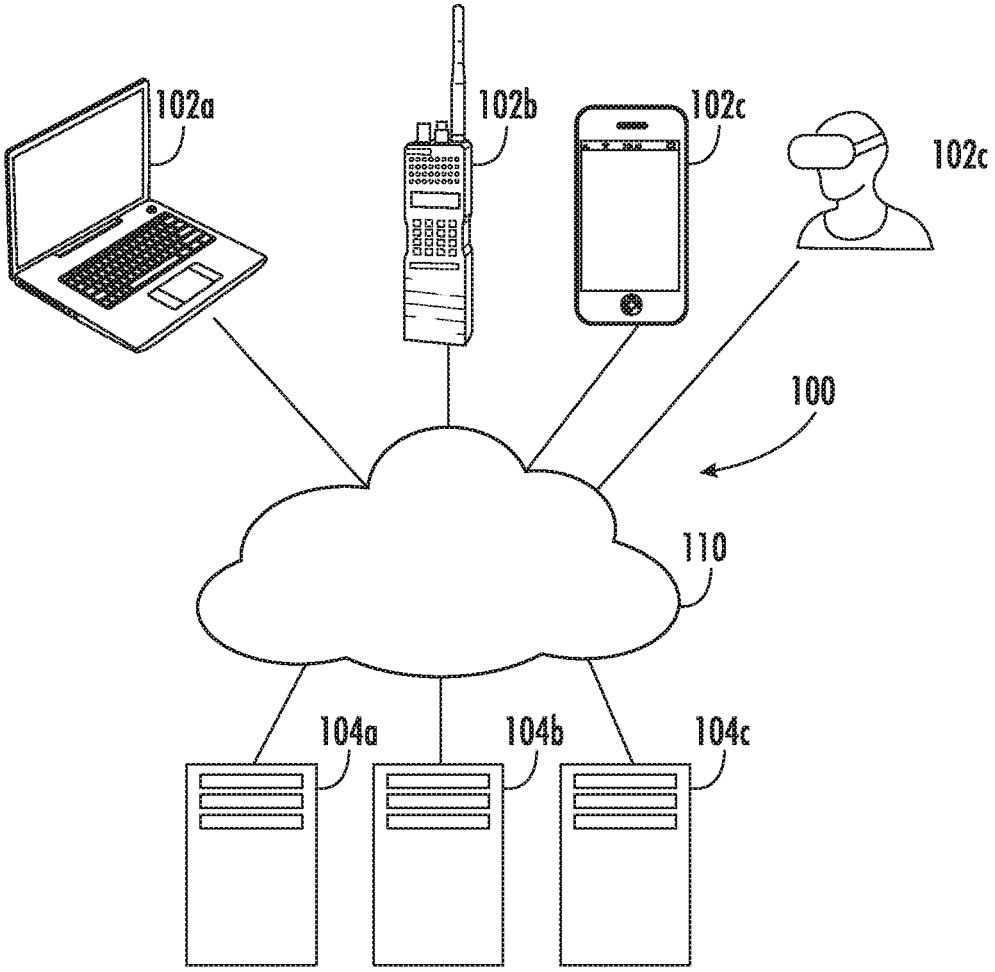
FIG. 1A shows a network diagram of different components of the system.

The system and method of treating amblyopia described may be implemented using system and hardware elements shown and described herein. For example, FIG. 1A shows an embodiment of a network 100 with one or more clients

102*a*, 102*b*, 102*c*, 102*d* that may be local machines, personal computers, mobile devices, servers, tablets, or virtual reality (VR) headsets that communicate through one or more networks 110 with servers 104*a*, 104*b*, 104*c*. It should be appreciated that a client 102*a*-102*d* may serve as a client seeking access to resources provided by a server and/or as a server providing access to other clients.

The network 110 may be wired or wireless. If it is wired, the network may include coaxial cable, twisted pair lines, USB cabling, or optical lines. The wireless network may operate using BLUETOOTH, Wi-Fi, Worldwide Interoperability for Microwave Access (WiMAX), infrared, or satellite networks. The wireless links may also include any cellular network standards used to communicate among mobile devices including the many standards prepared by the International Telecommunication Union such as 3G, 4G, and LTE. Cellular network standards may include GSM, GPRS, LTE, WiMAX, and WiMAX-Advanced. Cellular network standards may use various channel communications such as FDMA, TDMA, CDMA, or SDMA. The various networks may be used individually or in an interconnected way and are thus depicted as shown in FIG. 1A as a cloud.

The network 110 may be located across many geographies and may have a topology organized as point-to-point, bus, star, ring, mesh, or tree. The network 110 may be an overlay network which is virtual and sits on top of one or more layers of other networks.

In most cases, every device on a network has a unique identifier. In the TCP/IP protocol, the unique identifier for a computer is an IP address. An IPv4 address uses 32 binary bits to create a single unique address on the network. An IPv4 address is expressed by four numbers separated by dots. Each number is the decimal (base-10) representation for an eight-digit binary (base-2) number, also called an octet. An IPv6 address uses 128 binary bits to create a single unique address on the network. An IPv6 address is expressed by eight groups of hexadecimal (base-16) numbers separated by colons.

An IP address can be either dynamic or static. A static address remains constant for a system unless modified by a user. Dynamic addresses are assigned by the Dynamic Host Configuration Protocol (DHCP), a service running on the network. DHCP typically runs on network hardware such as routers or dedicated DHCP servers.

Dynamic IP addresses are issued using a leasing system, meaning that the IP address is only active for a limited time. If the lease expires, the computer will automatically request a new lease. Sometimes, this means the computer will get a new IP address, too, especially if the computer was unplugged from the network between leases. This process is usually transparent to the user unless the computer warns about an IP address conflict on the network (two computers with the same IP address).

Another identifier for a device is the hostname. A hostname is a human-readable label assigned to a device and can be modified by a user. Hostname can be resolved to the IP address of the device. This makes hostname a more reliable device identifier in a network with dynamic IP addresses.

Information in the IP Address may be used to identify devices, geographies, and networks. The hostname may be used to identify devices.

A system may include multiple servers 104*a*-*c* stored in high-density rack systems. If the servers are part of a common network, they do not need to be physically near one another but instead may be connected by a wide-area network (WAN) connection or similar connection.

Management of group of networked servers may be de-centralized. For example, one or more servers 104*a-c* may include modules to support one or more management services for networked servers including management of dynamic data, such as techniques for handling failover, data replication, and increasing the networked server's performance.

The servers 104*a-c* may be file servers, application servers, web servers, proxy servers, network appliances, gateways, gateway servers, virtualization servers, deployment servers, SSL VPN servers, or firewalls.

When the network 110 is in a cloud environment, the cloud network 110 may be public, private, or hybrid. Public clouds may include public servers maintained by third parties. Public clouds may be connected to servers over a public network. Private clouds may include private servers that are physically maintained by clients. Private clouds may be connected to servers over a private network. Hybrid clouds may, as the name indicates, include both public and private networks.

The cloud network may include delivery using IaaS (Infrastructure-as-a-Service), PaaS (Platform-as-a-Service), SaaS (Software-as-a-Service) or Storage, Database, Information, Process, Application, Integration, Security, Management, Testing-as-a-service. IaaS may provide access to features, computers (virtual or on dedicated hardware), and data storage space. PaaS may include storage, networking, servers or virtualization, as well as additional resources such as, e.g., the operating system, middleware, or runtime resources. SaaS may be run and managed by the service provider and SaaS usually refers to end-user applications. A common example of a SaaS application is SALESFORCE or web-based email.

A client 102*a-d* may access IaaS, PaaS, or SaaS resources using preset standards and the clients 102*a-c* may be authenticated. For example, a server or authentication server may authenticate a user via security certificates, HTTPS, or API keys. API keys may include various encryption standards such as, e.g., Advanced Encryption Standard (AES). Data resources may be sent over Transport Layer Security (TLS) or Secure Sockets Layer (SSL).

Figure 1B:
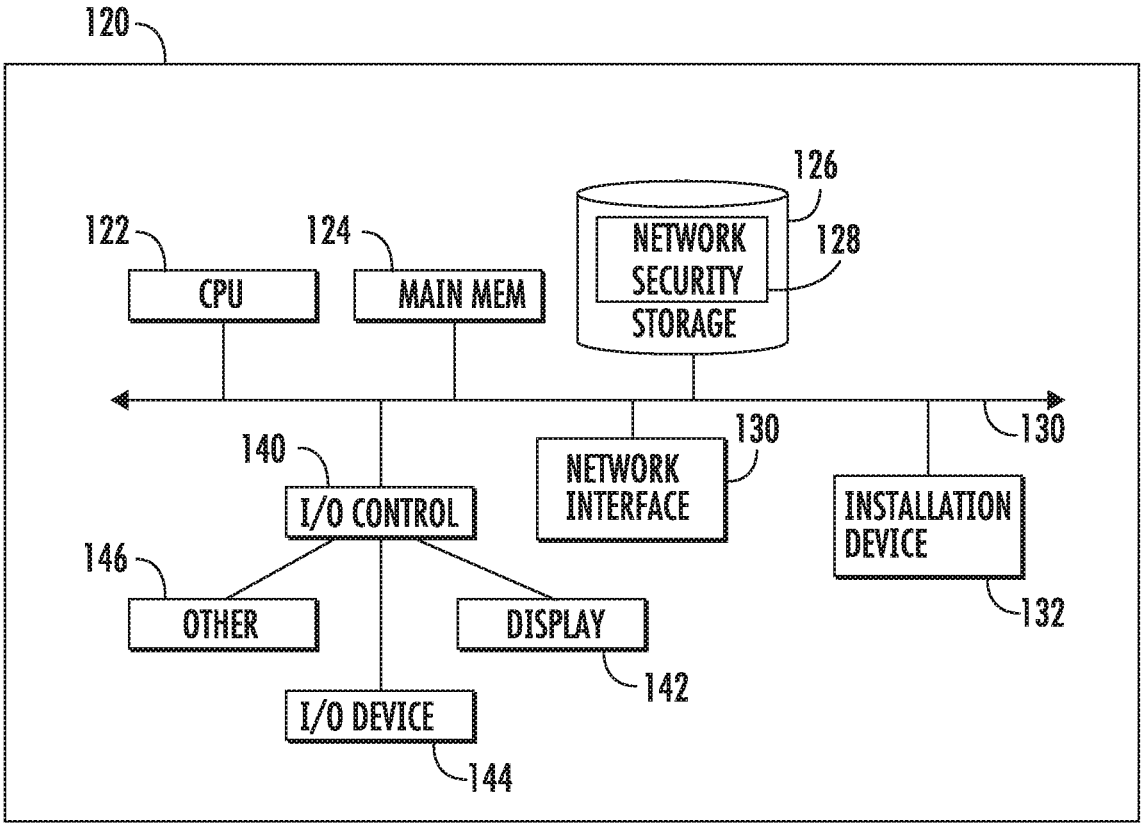
FIG. 1B certain hardware components for use with the system.

The clients 102*a-d* and servers 104*a-c* may be embodied in a computer, network device or appliance capable of communicating with a network and performing the actions herein. FIGS. 1A and 1B show block diagrams of a computing device 120 that may embody the client or server discussed herein. The device 120 may include a system bus 150 that connects the major components of a computer system, combining the functions of a data bus to carry information, an address bus to determine where it should be sent, and a control bus to determine its operation. The device includes a central processing unit 122, a main memory 124, and storage device 124. The device 120 may further include a network interface 130, an installation device 132 and an I/O control 140 connected to one or more display devices 142, I/O devices 144, or other devices 146 like mice and keyboards.

The storage device 126 may include an operating system, software, and a network user behavior module 128, in which may reside the network user behavior system and method described in more detail below.

The computing device 120 may include a memory port, a bridge, one or more input/output devices, and a cache memory in communication with the central processing unit.

The central processing unit 122 may be a logic circuitry such as a microprocessor that responds to and processes instructions fetched from the main memory 124. The CPU 122 may use instruction level parallelism, thread level parallelism, different levels of cache, and multi-core processors. A multi-core processor may include two or more processing units on a single computing component.

The main memory 124 may include one or more memory chips capable of storing data and allowing any storage location to be directly accessed by the CPU 122. The main memory unit 124 may be volatile and faster than storage memory 126. Main memory units 124 may be dynamic random access memory (DRAM) or any variants, including static random access memory (SRAM). The main memory 124 or the storage 126 may be non-volatile.

The CPU 122 may communicate directly with a cache memory via a secondary bus, sometimes referred to as a backside bus. In other embodiments, the CPU 122 may communicate with cache memory using the system bus 150. Cache memory typically has a faster response time than main memory 124 and is typically provided by SRAM or similar RAM memory.

Input devices may include keyboards, mice, trackpads, trackballs, touchpads, touch mice, multi-touch touchpads and touch mice, microphones, multi-array microphones, drawing tablets, cameras, single-lens reflex camera (SLR), digital SLR (DSLR), CMOS sensors, accelerometers, infrared optical sensors, pressure sensors, magnetometer sensors, angular rate sensors, depth sensors, proximity sensors, ambient light sensors, gyroscopic sensors, or other sensors. Output devices may include video displays, graphical displays, speakers, headphones, inkjet printers, laser printers, 3D printers, and VR headsets.

Additional I/O devices may have both input and output capabilities, including haptic feedback devices, touchscreen displays, or multi-touch displays. Touchscreen, multi-touch displays, touchpads, touch mice, or other touch sensing devices may use different technologies to sense touch, including, e.g., capacitive, surface capacitive, projected capacitive touch (PCT), in-cell capacitive, resistive, infrared, waveguide, dispersive signal touch (DST), in-cell optical, surface acoustic wave (SAW), bending wave touch (BWT), or force-based sensing technologies. Some multi-touch devices may allow two or more contact points with the surface, allowing advanced functionality including, e.g., pinch, spread, rotate, scroll, or other gestures.

In some embodiments, display devices 142 may be connected to the I/O controller 140. Display devices may include liquid crystal displays (LCD), thin film transistor LCD (TFT-LCD), blue phase LCD, electronic papers (e-ink) displays, flexile displays, light emitting diode displays (LED), digital light processing (DLP) displays, liquid crystal on silicon (LCOS) displays, organic light-emitting diode (OLED) displays, active-matrix organic light-emitting diode (AMOLED) displays, liquid crystal laser displays, time-multiplexed optical shutter (TMOS) displays, VR or 3D displays.

The computing device 120 may include a network interface 130 to interface to the network 110 through a variety of connections including standard telephone lines LAN or WAN links (802.11, T1, T3, Gigabit Ethernet), broadband connections (ISDN, Frame Relay, ATM, Gigabit Ethernet, Ethernet-over-SONET, ADSL, VDSL, BPON, GPON, fiber optical including FiOS), wireless connections, or some combination of any or all of the above. Connections can be established using a variety of communication protocols. The computing device 120 may communicate with other computing devices via any type and/or form of gateway or tunneling protocol such as Secure Socket Layer (SSL) or Transport Layer Security (TLS). The network interface 130 may include a built-in network adapter, network interface card, PCMCIA network card, EXPRESSCARD network card, card bus network adapter, wireless network adapter, USB network adapter, modem or any other device suitable for interfacing the computing device 120 to any type of network capable of communication and performing the operations described herein.

The computing device 120 may operate under the control of an operating system that controls scheduling of tasks and access to system resources. The computing device 120 may be running any operating system such as any of the versions of the MICROSOFT WINDOWS operating systems, the different releases of the Unix and Linux operating systems, any version of the MAC OS for Macintosh computers, any embedded operating system, any real-time operating system, any open source operating system, any proprietary operating system, any operating systems for mobile computing devices, or any other operating system capable of running on the computing device and performing the operations described herein.

The computer system 120 can be any workstation, telephone, desktop computer, laptop or notebook computer, netbook, tablet, server, handheld computer, mobile telephone, smartphone or other portable telecommunications device, media playing device, a gaming system, mobile computing device, or any other type and/or form of computing, telecommunications or media device that is capable of communication.

The status of one or more machines 102*a-c*, 104*a-c* may be monitored, generally, as part of network management. In one of these embodiments, the status of a machine may include an identification of load information (the number of processes on the machine, CPU and memory utilization), of port information (the number of available communication ports and the port addresses), session status (the duration and type of processes, and whether a process is active or idle), or as mentioned below. In another of these embodiments, this information may be identified by a plurality of metrics, and the plurality of metrics can be applied at least in part towards decisions in load distribution, network traffic management, and network failure recovery as well as any aspects of operations of the present solution described herein. Aspects of the operating environments and components described above will become apparent in the context of the systems and methods disclosed herein.

VR Headset as Client

Figure 2A:
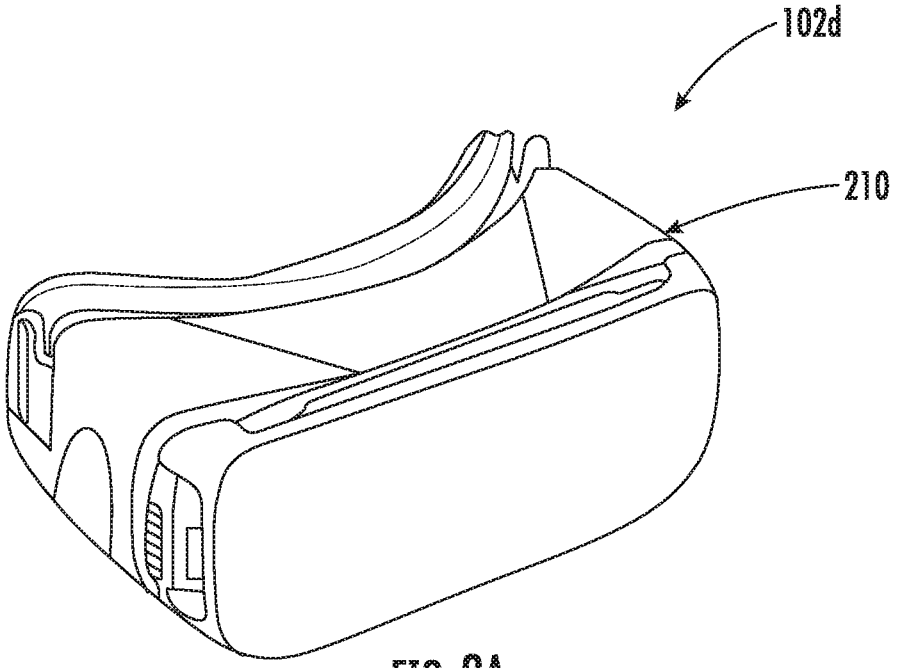
FIGS. 2A and 2B show a front and rear view of a VR headset used in the system described herein.
Figure 2B:
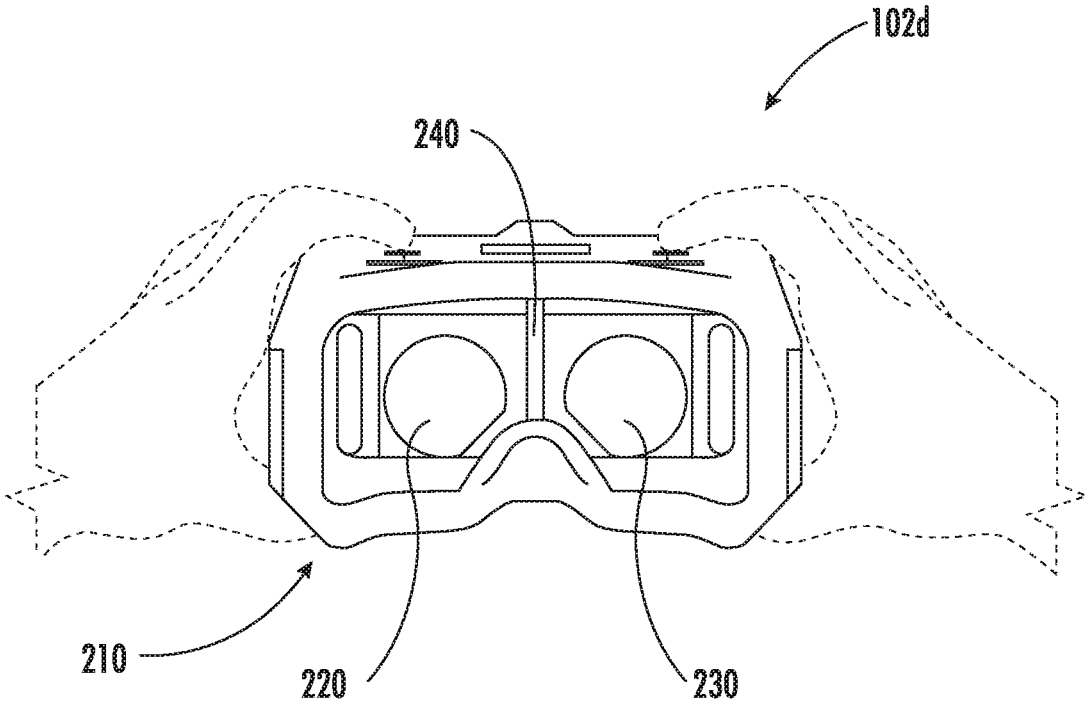

The VR headset 102*d* shown in FIG. 1A may be connected wired or wirelessly to another client (like a desktop to avoid latency issues) or cloud in a treatment setting. As shown in FIGS. 2A and 2B, the VR headset 102*d* is shaped for placement over a patient's head to isolate their eyes.

A VR headset or head-mounted display HMD 102*d* may include a frame 210 that can be mounted through a strap (not shown) to a user's head. The frame includes a left eye display 220 and a right eye display 230, separated by a divider 240, to create a stereoscopic effect and give the illusion of depth. The VR headset 102*d* also can include on-board processing and operating systems to allow an application to run locally. Some VR headsets incorporate positioning systems that track the user's head position and angle to allow a user to virtually look around a VR environment by moving their head. And some VR headsets 102*d* may also track eye movement and hand movement to bring additional details to attention and allow natural interactions with the VR environment.

A typical HMD 102*d* with two small displays 220, 230 may include lenses and semi-transparent mirrors embedded in eyeglasses (also termed data glasses), a visor, or a helmet. The display units 220, 230 may include cathode ray tubes (CRT), liquid crystal displays (LCDs), liquid crystal on silicon (LCoS), or organic light-emitting diodes (OLED). Some vendors employ multiple micro-displays to increase total resolution and field of view.

HMDs differ in whether they can display only computer-generated imagery (CGI), or only live imagery from the physical world, or combination. Most HMDs can display only a computer-generated image, sometimes referred to as virtual image. Some HMDs can allow a CGI to be superimposed on real-world view. This is sometimes referred to as augmented reality or mixed reality. Combining real-world view with CGI can be done by projecting the CGI through a partially reflective mirror and viewing the real world directly. This method is often called optical see-through. Combining real-world view with CGI can also be done electronically by accepting video from a camera and mixing it electronically with CGI. This method is often called video see-through.

While most HMDs are setup to simulate an immersive 3D environment using stereoscopic imaging techniques that take advantage of the two displays 220, 230, this is not required, and the HMDs can be used for simply viewing videos or web browsing, that is, in any traditional manner for using a display.

Some VR headsets 102*d* may include a slot for insertion or capture of a mobile phone, which itself provides the display that makes up the first and second displays by dividing the mobile phone display into two images.

In an amblyopia treatment setting, a patient may put on an HMD 102*d* under the guidance of a medical professional or following a plan proscribed by one. The HMD displays 220, 230 may begin to display content. The content may be a game, video, or any display that would engage the patient.

Before or during viewing, the displays 220, 230 may be adjusted in order to begin the treatment and "exercise" of the amblyopic eye. The adjustments may include the following to one or both displays in order to treat one of the yes by exercising it more than its counterpart.

No filter. There may be times when no filter will be applied to either eye.

Gaussian blur. In image processing, a Gaussian blur is the result of blurring an image by a Gaussian function. It is a widely used effect in graphics software, typically to reduce image noise and reduce detail. The visual effect of this blurring technique is a smooth blur resembling that of viewing the image through a translucent screen, distinctly different from the bokeh effect produced by an out-of-focus lens or the shadow of an object under usual illumination. Gaussian smoothing is also used as a pre-processing stage in computer vision algorithms in order to enhance image structures at different scales—see scale space representation and scale space implementation.

Mathematically, applying a Gaussian blur to an image is the same as convolving the image with a Gaussian function. This is also known as a two-dimensional Weierstrass transform. Since the Fourier transform of a Gaussian is another Gaussian, applying a Gaussian blur has the effect of reducing the image's high-frequency components.

Blackout. A blackout blanks or turns off a screen, in effect acting as a patch for the strong eye so that the weaker eye can do the work of observing the active display.

Grayscale. The grayscale filter converts all color images to a variation of grey. Grayscale images can be the result of measuring the intensity of light at each pixel according to a particular weighted combination of frequencies (or wavelengths), and in such cases they are monochromatic proper when only a single frequency (in practice, a narrow band of frequencies) is captured. The frequencies can in principle be from anywhere in the electromagnetic spectrum (e.g. infrared, visible light, ultraviolet, etc.). Grayscale conversion may be done using colormetric or Luma coding methods.

Single color. In a single-color filter, all but one color may be mapped to a grayscale shade.

Low-pass. A low-pass filter (LPF) is a filter that passes signals with a frequency lower than a certain cutoff frequency and attenuates signals with frequencies higher than the cutoff frequency. The exact frequency response of the filter depends on the filter design. The filter is sometimes called a high-cut filter, or treble-cut filter in audio applications. A low-pass filter is the complement of a high-pass filter. An optical filter with the same function can correctly be called a low-pass filter, but conventionally is called a longpass filter (low frequency is long wavelength).

Laplace Transform. A low pass variant may use a Laplace transform of an impulse response, in a way that lets all characteristics of the filter be analyzed by considering the pattern of poles and zeros of the Laplace transform in the complex plane. (In discrete time, one can similarly consider the Z-transform of the impulse response.)

Multi-color. The color filters filter the light by wavelength range, such that the separate filtered intensities include information about the color of light. For example, a Bayer filter gives information about the intensity of light in red, green, and blue (RGB) wavelength regions. A raw image may be converted to a full-color image (with intensities of all three primary colors represented at each pixel) by a demosaicing algorithm that is tailored for each type of color filter. The spectral transmittance of the CFA elements along with the demosaicing algorithm jointly determine the color rendition.

Lossy compression. Lossy compression or irreversible compression is the class of data encoding methods that uses inexact approximations and partial data discarding to represent the content. These techniques may be used to reduce data size for storage, handling, and transmitting content. Different versions of the photo of the cat above show how higher degrees of approximation create coarser images as more details are removed.

Bayer. A Bayer filter mosaic is a color filter array (CFA) for arranging RGB color filters on a square grid.

One or more of the above filters may be used at once, in sequence or as part of an ongoing treatment of a patient according to a treatment plan proscribed by a medical professional.

In use, when a patient wears the HMD, they interact with the program or video being run in in the displays just as they normally would, through the various input devices noted above. And during this interaction, they may sense the application of the filters, but this should not materially affect their interaction with the program. Thus, while they are receiving a form of entertaining therapy. This is particularly appealing for children, who can "go play a game for an hour," whereby the hour is actually an hour of eye exercise for an Amblyopic eye.

Any gaming or video streaming may be done in 2D or simulated 3D using stereoscopic images.

System Interface

FIGS. 3-6 show an overview of user, physician, and patient interfaces to control different aspects of the treatment.

User Interface

Upon starting the interface, a user may encounter a Login Page as the first point of entry of the application where the user may interact with the treatment. This page is designed for the guardian of the patient (or alternatively, the patient themselves if they are legal age). There are two ways to login; a physician provided Access Code, or optionally, an Email Address and associated Password. The Forgot Password link allows for Password reset, and the Terms link allows them to read certain Terms and Conditions upon which the application may be used.

Figure 3:
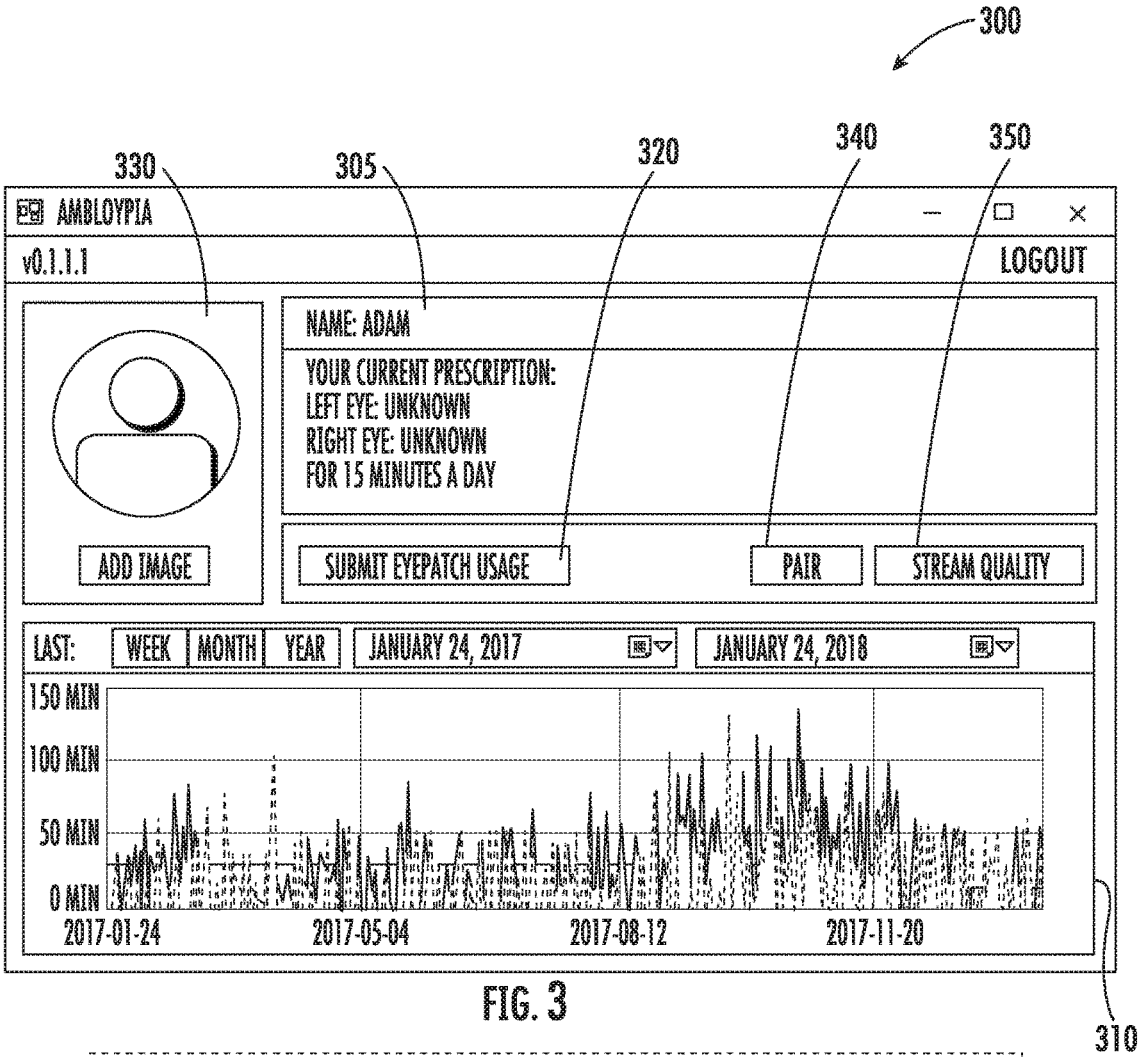
FIG. 3 shows a main page of a user application.
Figure 4:
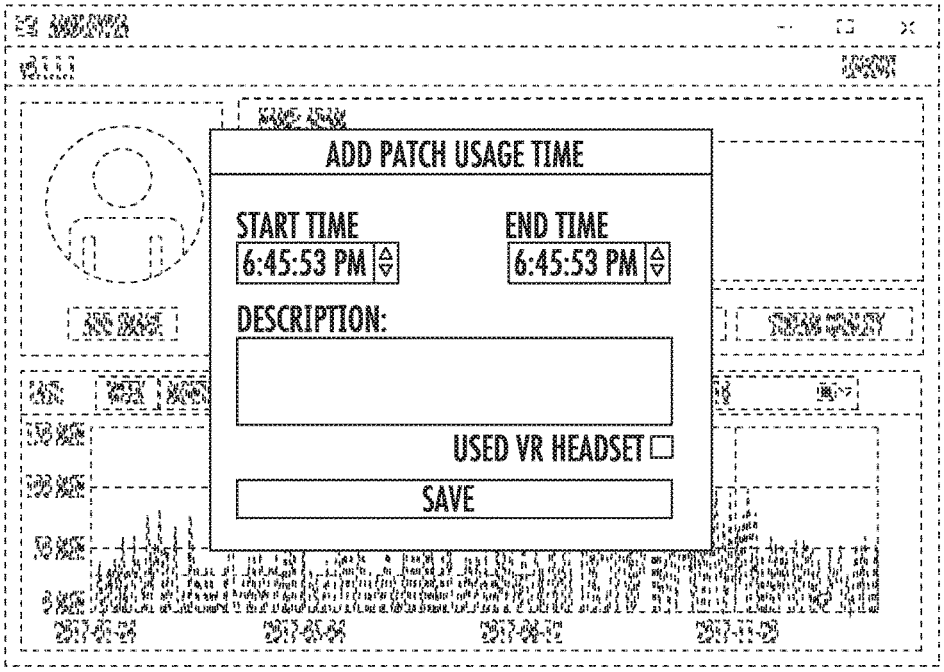
FIG. 4 shows the standard patch treatment pop-up window.

After a successful login, the user may arrive at a main page 300 as shown in FIG. 3. The Main Page is where the guardian of the patient ("Adam") can see the patient's bibliographic information 305, and their progress over a configurable date range 310. The main page 300 also allows for entering standard treatment 310 in cases where the VR headset could not be used (FIG. 4 shows the standard patch treatment pop-up window). The guardian can also add a picture of the patient 330. A user can pair a phone 340 to begin streaming VR content directly from a source, such as a desktop computer or the Internet, and choose the stream image quality 350.

A pair page allows the guardian to enter a code provided by the VR headset that allows them to pair to any VR headset. It sends the router address information via a web socket on the server in order to setup a connection without the patient or guardian entering anything complicated.

A streaming content page allows the guardian to select which window on their desktop (of possible windows currently active) that will be streamed to the HMD.

The guardian may also be able to access more than one patient if they have more than one child/patient in treatment.

Physician Interface

The physician or medical professional interface differs from the user/guardian interface in that it may be focused on patient treatment and results.

A physician may login with an admin provided access code, or an email address/ID and associated password. A terms link allows a physician to read the Terms and Conditions.

Figure 5:
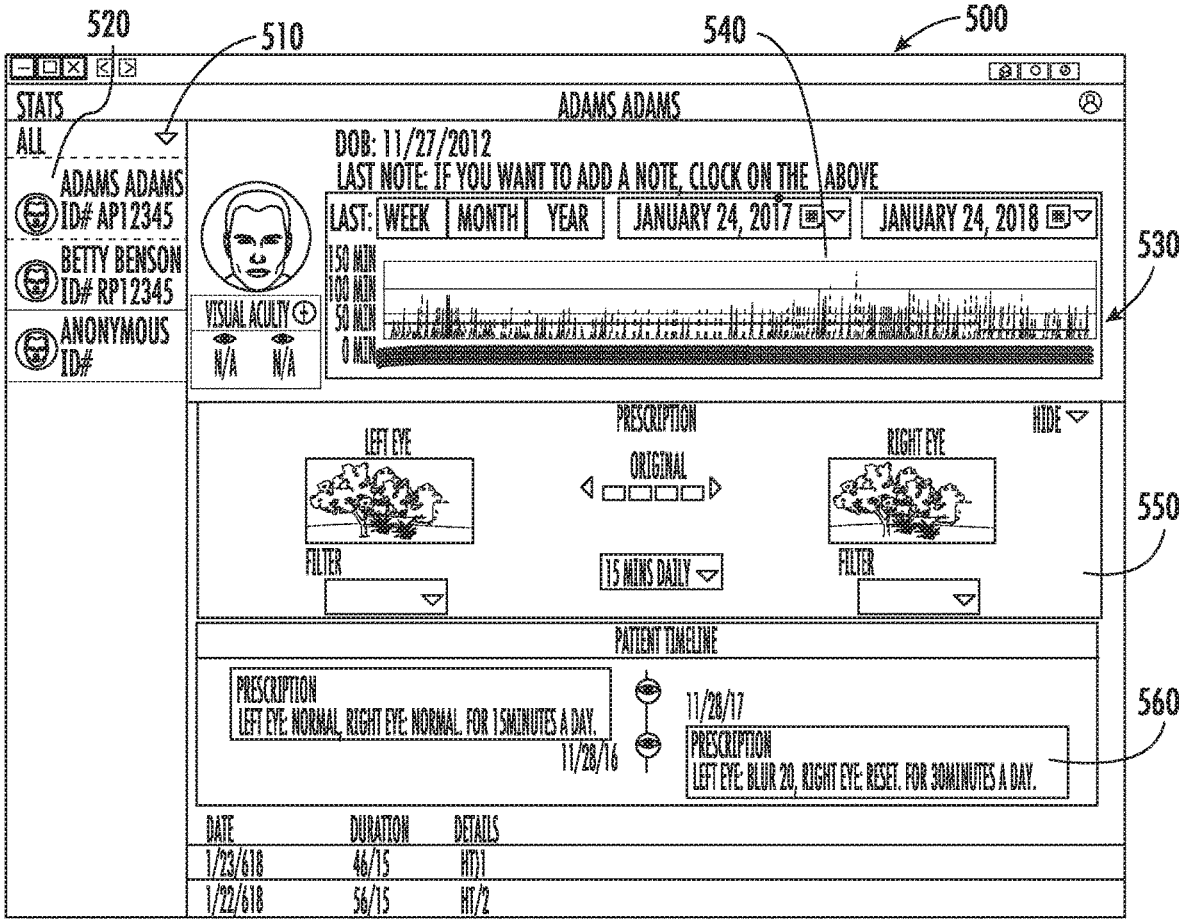
FIG. 5 shows a physician main page.

Following login, a physician enters the physician main page 500 shown in FIG. 5. The physician main page 500 allows a physician to select the study they are interested in (top left dropdown menu 510 that says ALL). Under the dropdown is the list of patients (who can be anonymized depending on the study) 520. The selected cell (Adam Aadms) on the left populates the patient's data 530 on the right. At the top is the general info such as the client photo and bibliographic information, as well as a graph of the patient's adherence 540. Underneath is the prescription, the physician can select a filter option for each eye, and a duration 550, as well as select recommended programs for the patient to follow. The bottom list is a history of the healthcare patient history 560.

Figure 6:
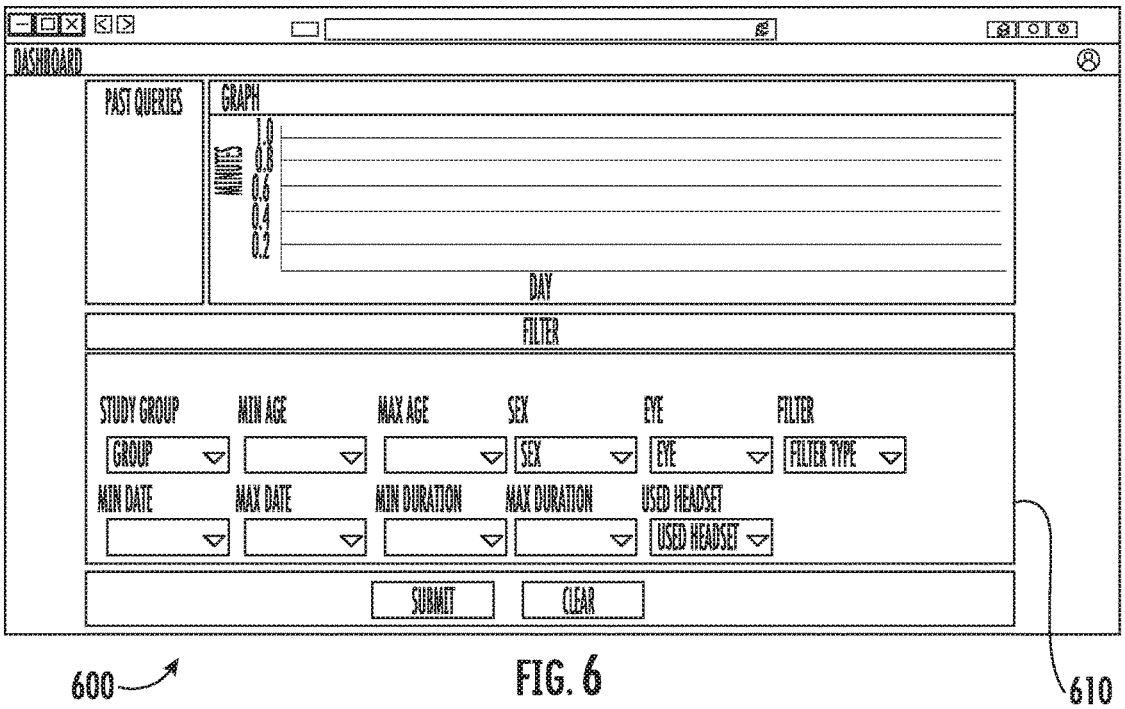
FIG. 6 shows a physician study detail page.

FIG. 6 shows a physician study detail page 600 that shows aggregate detail of a study, and filter the adherence and improvement data base on any of the options 510.

The physician can also add and remove other researchers to a study, giving them permission to see HIPAA compliant data, or anonymize the data.

Patient Interface

A patient may interface with the system in a different way from the guardian or physician, and for an HMD that uses a mobile phone as its display element, the patent interface may be accessed through a mobile phone application. Following a login, the patient may see a main page that allows the patient to select avatars The patient main page may allow the patient to select an avatar that represents them and pair the VR headset with the user interface streaming app. The patient may be able to purchase VR interface avatars, or select an activity to stream content to the display such as playing a game, viewing a stream, or even just browsing the web.

System Network

Figure 7:
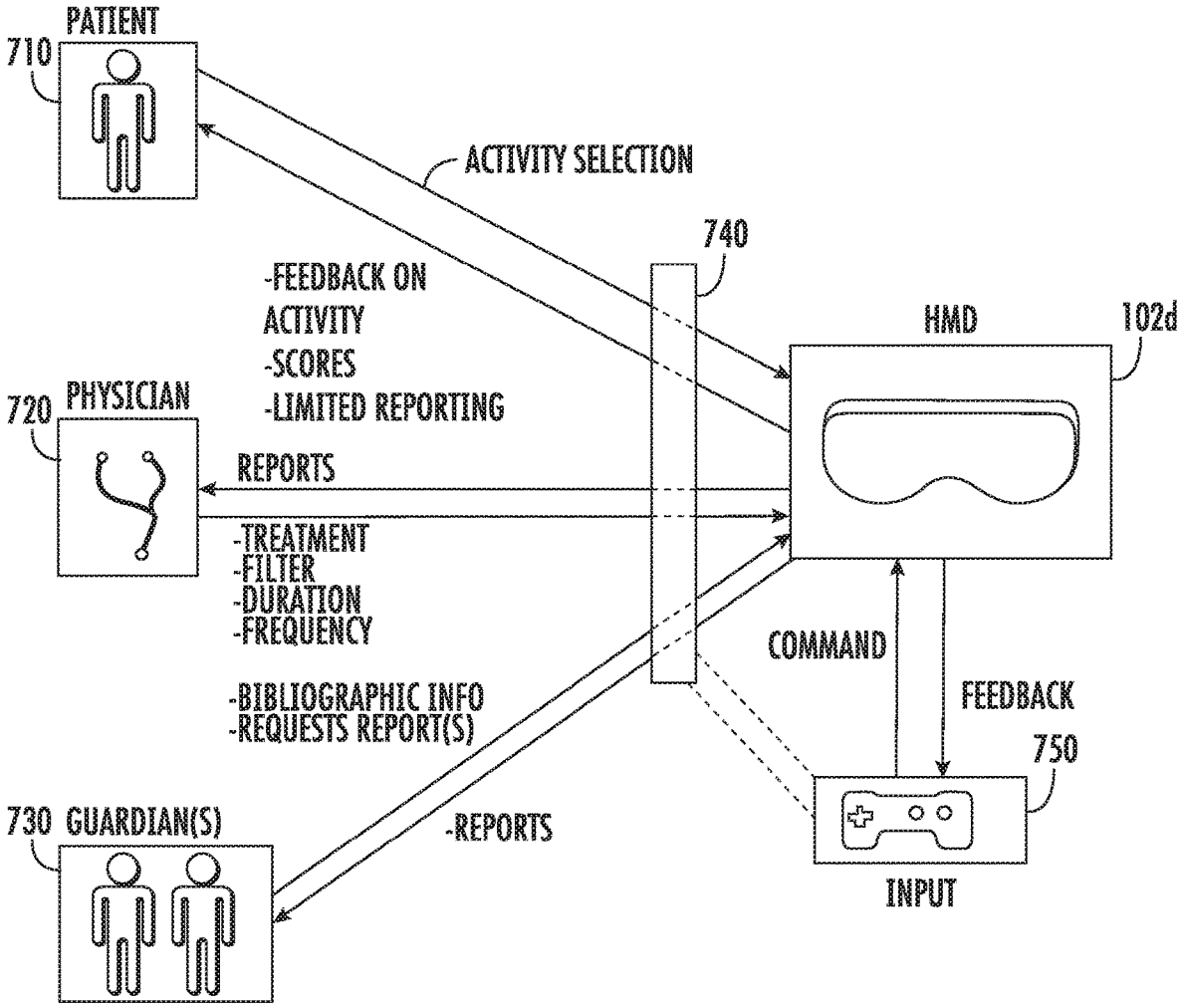
FIG. 7 depicts different user interaction with the HMD.

A patient 710, physician 720, and guardian-user 730 may interact with the HMD 102*d* using a network model shown in FIG. 7. Each one of the patient 710, physician 720, and guardian-user 730 may send and receive information to a computer or cloud-based client 740 that controls and interfaces with the HMD 102*d*. The client 740 provides content to the HMD 102*d*, sets various parameters for treatment set by the physician, and acts as a patient's 710 source and gatekeeper of content displayed on the HMD. Input sources 750 such as joysticks, keyboards, mice, and those mentioned above may interact with the HMD directly or with the client 740 to allow a patient to control actions portrayed in the HMD 102*d*'s display.

The patient 710 may request certain activity selections for use with the HMD 102*d*, for example, web browsing or game play. The patient 710 may receive from the HMD 102*d* or client 740 feedback on the activity including haptic feedback, scores, rewards, or even age-appropriate reports. The physician 720 may provide treatment options for the patient 710 in the form of filter choices, duration of sessions, frequency of interaction, and the like. The physician 720 may receive reports on the patient's 710 progress.

The guardian(s) 730 may fill in bibliographic information and request reports from the client 740, or input access controls for certain activities, and receive reports.

All of the users 710, 720, 730 may interact with the HMD 102*d*, client 740, and inputs 750 in the manner described herein.

While the invention has been described with reference to the embodiments above, a person of ordinary skill in the art would understand that various changes or modifications may be made thereto without departing from the scope of the claims.

The invention claimed is:

1. A method for treating amblyopia in a patient comprising:

providing a virtual reality headset having a display that provides a first display to a left eye and a second display to a right eye; and manipulating one of the first display or the second display such that the manipulation encourages a patent's amblyopic eye to perform more work than a non-amblyopic eye, wherein one of the first display or second display are manipulated using one or more of a preset selection of available filters, the preset selection of available filters including: a blank filter, a grayscale filter, a single-color filter, a low pass filter, a Laplace transform filter, a multicolor filter, a lossy compression filter, and a Bayer filter.

2. The method of claim 1, wherein the manipulation includes providing no image to one of the first or second display.

3. The method of claim 1, further comprising providing a physician interface wherein a physician can plan a treatment program for a patient.

4. The method of claim 3, wherein the treatment program comprises controlling a style of the manipulation.

5. The method of claim 3, wherein the treatment program comprises controlling a duration of the manipulation.

6. The method of claim 3, further comprising providing patient information through the physician interface to the physician.

7. The method of claim 1, further comprising providing content to one or both of the displays.

8. The method of claim 7, wherein the content is a game.

9. The method of claim 7, wherein the content is a streaming video.

10. The method of claim 7, wherein the content is an Internet interface.

* * * * *